US010837430B2

(12) United States Patent
Zankl et al.

(10) Patent No.: US 10,837,430 B2
(45) Date of Patent: Nov. 17, 2020

(54) HIGH-PRESSURE FUEL PUMP FOR A FUEL INJECTION SYSTEM

(71) Applicant: CONTINENTAL AUTOMOTIVE GMBH, Hannover (DE)

(72) Inventors: Markus Zankl, Waldmünchen (DE); Bernd Wöllisch, Chamerau (DE); Heiko Zabich, Regensburg (DE); Yury Mikhaylov, Landshut (DE); Thomas Fuchs, Fladungen (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 70 days.

(21) Appl. No.: 15/914,289

(22) Filed: Mar. 7, 2018

(65) Prior Publication Data

US 2018/0258892 A1 Sep. 13, 2018

(30) Foreign Application Priority Data

Mar. 8, 2017 (DE) ..... 10 2017 203 762

(51) Int. Cl.

| | |
|---|---|
| ***F04B 11/00*** | (2006.01) |
| ***F02M 37/00*** | (2006.01) |
| ***F02M 55/04*** | (2006.01) |
| ***F04B 19/22*** | (2006.01) |

(Continued)

(52) U.S. Cl.

CPC ..... *F04B 11/0016* (2013.01); *F02M 37/0041* (2013.01); *F02M 55/04* (2013.01);

(Continued)

(58) Field of Classification Search

CPC ... F04B 11/00; F04B 11/0008; F04B 11/0016; F04B 11/0033; F04B 11/0091; F04B 39/0027; F04B 39/0033; F04B 39/005; F04B 39/0055; F04B 39/0061; F04B 53/001; F04B 53/002; F04B 19/22; F04B 1/0443; F04B 53/04; F04B 53/16;

(Continued)

(56) References Cited

U.S. PATENT DOCUMENTS

2012/0195778 A1 8/2012 Koga et al.
2012/0247591 A1* 10/2012 Kuroyanagi ..... F02M 59/368 137/565.01

(Continued)

FOREIGN PATENT DOCUMENTS

DE 10327408 A1 4/2004
DE 102016203606 A1 9/2016

(Continued)

OTHER PUBLICATIONS

German Office Action dated Nov. 23, 2017 for corresponding German Patent Application No. 10 2017 203 762.8.

(Continued)

*Primary Examiner* — Patrick Hamo
*Assistant Examiner* — Chirag Jariwala

(57) ABSTRACT

Embodiments relate to a high-pressure fuel pump having a pump piston which, during operation, moves in translation between a pressure chamber and a leakage chamber. The leakage chamber has a leakage collecting region and an equalizing region. A low-pressure damper having a bellows-shaped corrugated damper plate is arranged in the equalizing region.

10 Claims, 6 Drawing Sheets

(51) Int. Cl.
*F04B 53/16* (2006.01)
*F04B 53/04* (2006.01)
*F02M 59/44* (2006.01)

(52) U.S. Cl.
CPC ..... *F04B 19/22* (2013.01); *F04B 53/04* (2013.01); *F04B 53/16* (2013.01); *F02M 59/442* (2013.01); *F02M 2200/315* (2013.01); *F04B 2201/0803* (2013.01)

(58) Field of Classification Search
CPC ..... F04B 2201/0803; F02M 55/04; F02M 37/0041; F02M 59/025; F02M 59/027; F02M 59/466; F02M 59/442; F02M 2200/31; F02M 2200/315; F02M 59/07; F02M 59/44; F02M 59/46; F04C 15/0049
USPC ..... 417/540
See application file for complete search history.

(56) References Cited

U.S. PATENT DOCUMENTS

| | | | | |
|---|---|---|---|---|
| 2016/0208796 | A1* | 7/2016 | Nigrin | F02M 59/14 |
| 2016/0258427 | A1* | 9/2016 | Suda | F04B 11/0091 |
| 2018/0313313 | A1* | 11/2018 | Kitajima | F02M 59/26 |

FOREIGN PATENT DOCUMENTS

| | | | |
|---|---|---|---|
| DE | 102015214812 | A1 | 2/2017 |
| EP | 2317119 | A1 | 5/2011 |
| JP | 2003113759 | A | 4/2003 |
| JP | 2016164400 | A | 9/2016 |
| JP | 2017025924 | A | 2/2017 |
| KR | 20010020755 | A | 3/2001 |
| KR | 1020150132016 | A | 11/2015 |

OTHER PUBLICATIONS

Japanese Office Action dated Nov. 12, 2018 for corresponding Japanese application No. 2018-039923.
Japanese Notice of Allowance dated Apr. 8, 2019 for corresponding Japanese application No. 2018-039923.
Korean Office Action datedd Apr. 3, 2019 for corresponding Korean application No. 10-2018-0026546.
Indian Examination Report dispatched Feb. 28, 2020 for corresponding Indian Patent Application No. 201814003347.
Korean Grant of Patent dispatched Mar. 6, 2020 for corresponding Korean Patent Application No. 10-2018-0026546.

* cited by examiner

HIGH-PRESSURE FUEL PUMP FOR A FUEL INJECTION SYSTEM

CROSS REFERENCE TO RELATED APPLICATIONS

This application claims priority to German patent application No. 10 2017 203 762.8, filed on Mar. 8, 2017, the content of which is hereby incorporated by reference in its entirety.

FIELD OF INVENTION

The invention relates to a high-pressure fuel pump for applying high pressure to fuel in a fuel injection system.

BACKGROUND

High-pressure fuel pumps of this kind are used in fuel injection systems in order to compress, and thus apply high pressure to, fuel. The fuel under high pressure is then injected, by means of a fuel injection device, into combustion chambers of an internal combustion engine. In the case of gasoline internal combustion engines, the pressure is between 150 and 400 bar, and in the case of diesel internal combustion engines, the pressure is between 1500 and 3000 bar. The more the fuel is compressed, the lower the emissions produced during the combustion process. This is advantageous in particular in the context of emissions reduction which is increasingly sought-after and is required by law.

These high-pressure fuel pumps are usually designed as piston pumps, the fuel being compressed by a pump piston in a pressure chamber by means of a translatory movement of the pump piston. The uneven delivery of such piston pumps produces, on a low-pressure side of the high-pressure fuel pump, fluctuations in the volume flow, which are linked to pressure fluctuations in the system as a whole. As a consequence of these fluctuations, the high-pressure fuel pump can experience filling losses, so that correct metering of the quantity of fuel required in the internal combustion engine cannot be ensured. In addition, these pressure pulsations induce oscillations in components of the high-pressure fuel pump, which can cause undesirable noise or even damage to the individual components.

Therefore, in order to damp these pressure pulsations, low-pressure dampers are used on the low-pressure side, these dampers operating as hydraulic accumulators which smooth the fluctuations in the volume flow and thus reduce the resulting pressure pulsations. To that end, these low-pressure dampers usually have deformable elements. Now, if the pressure at the low-pressure side rises, these deformable elements deform, thus making space for the excess fuel in the volume flow. When the pressure subsequently drops, the deformable element returns to its original shape and the stored fuel is thus released.

Low-pressure dampers of this kind are known for example from DE 10 2015 214 812 A1, which discloses a conventional high-pressure fuel pump having a low-pressure damper which is mounted on a head region of the high-pressure fuel pump.

A conventional high-pressure fuel pump of this kind has the drawback that, when the low-pressure damper is arranged on a head of the high-pressure fuel pump, other elements such as a metering valve must be provided laterally on a housing of the high-pressure fuel pump. However, this means that the fuel that is to be drawn in has to be drawn around a corner, which is not optimal in terms of fluid flow. Furthermore, head mounting means an additional outward interface which must be securely sealed. In addition, a damper cover, which closes the low-pressure damper, acts as a loudspeaker that projects sound waves upward, which is disadvantageous in terms of noise.

SUMMARY

The invention therefore has the object of proposing an improved high-pressure fuel pump.

A high-pressure fuel pump for applying high pressure to fuel in a fuel injection system has a housing having a housing bore which forms, at a first end region, a pressure chamber in which high pressure is applied to the fuel, and forms, at a second end region, a leakage chamber. The high-pressure fuel pump also includes a pump piston which is guided in a pump piston guiding region, formed by a pump piston guiding section of the housing, of the housing bore, and which, during operation of the high-pressure fuel pump, moves in translation between the pressure chamber and the leakage chamber along an axis of movement. The leakage chamber has the leakage collecting region and an equalizing region, wherein the equalizing region is arranged in circular annular fashion around the pump piston guiding section of the housing and extends parallel to the axis of movement from the leakage collecting region toward the pressure chamber. The high-pressure fuel pump also includes a low-pressure damper having a bellows-shaped corrugated damper plate which bounds a damper volume. The low-pressure damper is arranged in the equalizing region.

In one embodiment, the circularly annular equalizing region extends not only parallel to the axis of movement but also concentrically therewith. An eccentric arrangement is also possible, depending on requirements.

It was hitherto known to provide low-pressure dampers at a head end of the housing of the high-pressure fuel pump. By contrast, what is now proposed is to provide such a low-pressure damper inside the housing of the high-pressure fuel pump, specifically below the pump piston in the leakage chamber which collects leakage fuel escaping along the pump piston from the pressure chamber. This allows other elements, which are to be attached to a head end of the housing, to be arranged on the housing as flexibly as possible in relation to the pump architecture and the interfaces. In addition, an external interface which must also be sealed is no longer necessary since the low-pressure damper is arranged within the housing of the high-pressure fuel pump. Also, pump noises are no longer projected outward but rather into an adjoining engine block underneath. This makes the high-pressure fuel pump quieter overall.

The leakage chamber of the high-pressure fuel pump is made up of two regions, namely a leakage collecting region and an equalizing region. In that context, the leakage collecting region is arranged only at the specific point where the leakage fuel exits the pump piston guiding section of the housing. The equalizing region makes available the actual volume of the leakage chamber. Advantageously, the equalizing region is arranged in a circularly annular manner around the pump piston guiding section, which is advantageous with regard to the overall architecture of the high-pressure fuel pump. In particular, the equalizing region may therefore absorb and divert forces which arise in the housing when the housing is attached to other elements of the fuel injection system. The low-pressure damper is no longer arranged only generally in the leakage chamber, but rather specifically in this equalizing region. Particularly advantageously, it is located exclusively in this equalizing region of the leakage chamber, since the equalizing region provides the greatest volume for a low-pressure damper, which may therefore also be made as large as possible. In order to obtain a particularly good damper action, the low-pressure damper is in the overall shape of a bellows and therefore has a corrugated damper plate. The low-pressure damper may operate effectively in the direction of propagation of the corrugations of the damper plate.

The low-pressure damper is designed as a damper circular ring having a circular ring wall thickness perpendicular to the axis of movement and an extent length parallel to the axis of movement. In that context, the circular ring wall thickness is smaller than the extent length. Such a design makes it possible for the low-pressure damper to expand particularly far parallel to the pump piston guiding section of the housing, and thus for the space of the equalizing region to be used particularly effectively.

The equalizing region is also advantageously in the form of an equalizing region circular ring which also has a circular ring wall thickness smaller than an extent length parallel to the axis of movement. Thus, the equalizing region advantageously extends particularly into the housing of the high-pressure fuel pump and may therefore dissipate particularly well forces acting from outside on the housing.

The bellows-shaped corrugated damper plate has corrugations which propagate parallel to the axis of movement, in particular concentrically with the latter. This advantageously makes it possible to make full use, for a damper action, of an extent length of the equalizing region parallel to the axis of movement.

Alternatively, however, it is also possible that the bellows-shaped corrugated damper plate has corrugations which propagate in annular fashion around the pump piston guiding section of the housing.

In one configuration, the leakage collecting region is bounded by a sealing shell which is secured pressed against a housing wall of the housing bore. Pressing the sealing shell against the housing wall of the housing bore seals the leakage region with respect to the outside. The seal is further improved by welding or screw-fitting the sealing shell in addition to pressing. These securing methods make it advantageously possible to absorb any forces which act. Since the leakage region is therefore already closed by a corresponding element, namely by the sealing shell, it is possible to dispense with an external interface, which must also be sealed, of the low-pressure damper. It is thus possible to reduce the number of components of the high-pressure fuel pump while retaining the same function.

Advantageously, the low-pressure damper is secured, in particular by welding, to the sealing shell. To that end, the low-pressure damper may for example have a flange by means of which the low-pressure damper is welded to the sealing shell. This flange may advantageously be designed such that it does not contribute to forming the damper volume and acts only for securing the low-pressure damper to the sealing shell. It may be designed such that it is possible to allow that side of the low-pressure damper facing away from the sealing shell to project freely into the equalizing region of the leakage chamber without further securing means. This allows the low-pressure damper to expand freely.

It is however also possible, alternatively or additionally, for the low-pressure damper to be secured to the housing wall to which the sealing shell is also secured by pressing. This securing may then, for example, equally be carried out by pressing, but also by welding to the housing wall. If the low-pressure damper is secured only to the housing wall, and not also to the sealing shell, it is possible for the low-pressure damper to expand freely parallel to the axis of movement at both end regions.

It is also conceivable, alternatively or additionally, for the low-pressure damper to be secured to the pump piston guiding section of the housing, wherein this may also involve pressing or welding with the same advantages as for securing to the housing wall.

The damper plate forms a hermetically closed capsule which forms the damper volume. In that context, the capsule can for example be made by a single damper plate which is appropriately bent, but it is also possible for the damper plate to consist of multiple individual parts which are welded to one another in a sealed manner and thus form the complete damper plate.

The damper volume is advantageously filled with a gas, which is more easily compressed than a liquid, in order to thus achieve better or best possible damping action for the low-pressure damper.

In one possible embodiment, the damper plate, together with a part region of the sealing shell, forms a hermetically closed capsule which forms the damper volume. For example, it is therefore possible for the damper plate to be in the form of a single bent plate and to be provided with two corresponding flanges which are then easily welded to the sealing shell.

In one embodiment, the part region of the sealing shell, which together with the damper plate forms the closed capsule, is formed by a piston support plate pressed into the sealing shell. This makes it possible for the low-pressure damper to easily be pre-mounted on the piston support plate, and then only subsequently pressed into the sealing shell.

It is also conceivable that, even if the piston support plate does not help to form the boundary of the damper volume, the low-pressure damper is simply welded onto this piston support plate in order to thus form a pre-assembled subunit.

Advantageously, the housing has, adjacent to the pressure chamber and opposite the leakage chamber with respect to the pump piston, an intake for introducing fuel into the high-pressure fuel pump. The intake is fluidically connected to the leakage chamber. In that context, in particular an intake connecting bore, which extends essentially parallel to the pump piston guiding region of the housing bore between the intake and the leakage chamber, is arranged in the housing. Alternatively, a non-parallel arrangement of the intake connecting bore relative to the pump piston guiding region is also conceivable, but less advantageous in terms of the required installation space.

In an embodiment, an electromagnetic switching valve, as a metering valve for metering fuel to the pressure chamber, is arranged on the housing adjacent to the pressure chamber and opposite the leakage chamber with respect to the pump piston, wherein an inlet of the electromagnetic switching valve is fluidically connected to the leakage chamber. In particular a valve connecting bore, which extends essentially parallel to the pump piston guiding region of the housing bore between the inlet of the electromagnetic switching valve and the leakage chamber, is arranged in the housing. Alternatively, a non-parallel arrangement of the valve connecting bore relative to the pump piston guiding region is also conceivable, but less advantageous in terms of the required installation space.

For that reason, the leakage chamber advantageously has, via the intake connecting bore, a direct fluidic connection to the intake of the high-pressure fuel pump and, via the valve connecting bore, a direct connection to the electromagnetic switching valve. The intake connecting bore, the valve connecting bore and the leakage chamber may be arranged such that the intake of fuel to the electromagnetic switching valve takes place exclusively via the leakage chamber. Thus, there is advantageously no direct connection between the intake and the inlet of the electromagnetic switching valve. This makes it possible for pressure pulsations, which are due to the operation of the electromagnetic switching valve, to be effectively cushioned by the low-pressure damper since the fuel must necessarily pass by the low-pressure damper.

Another advantage, if the fuel from the intake must pass by the leakage chamber, is that leakage fuel, which flows along the pump piston from the pressure chamber into the leakage chamber, may then be cooled directly by the inflowing fresh fuel.

Fluidically, it is advantageous if the intake connecting bore and the valve connecting bore are arranged exactly opposite one another relative to the pump piston.

A valve connecting bore diameter of the valve connecting bore is larger than an intake connecting bore diameter of the intake connecting bore.

If, for reasons of installation space, it is not possible to create, in the housing of the high-pressure fuel pump, a valve connecting bore having a particularly large diameter, it is also possible to provide multiple valve connecting bores which then together form the overall valve connecting bore diameter that is then larger than the intake connecting bore diameter.

The result of this is that the outflow from the leakage chamber is throttled in the direction of the intake at that moment when fuel from the electromagnetic switching valve flows back into the leakage chamber, for example due to induced pressure pulsations. This throttle advantageously forces the low-pressure damper to work effectively.

BRIEF DESCRIPTION OF THE DRAWINGS

Advantageous configurations of the invention will be discussed in more detail below on the basis of the appended drawings, in which.

DETAILED DESCRIPTION

Figure 1:
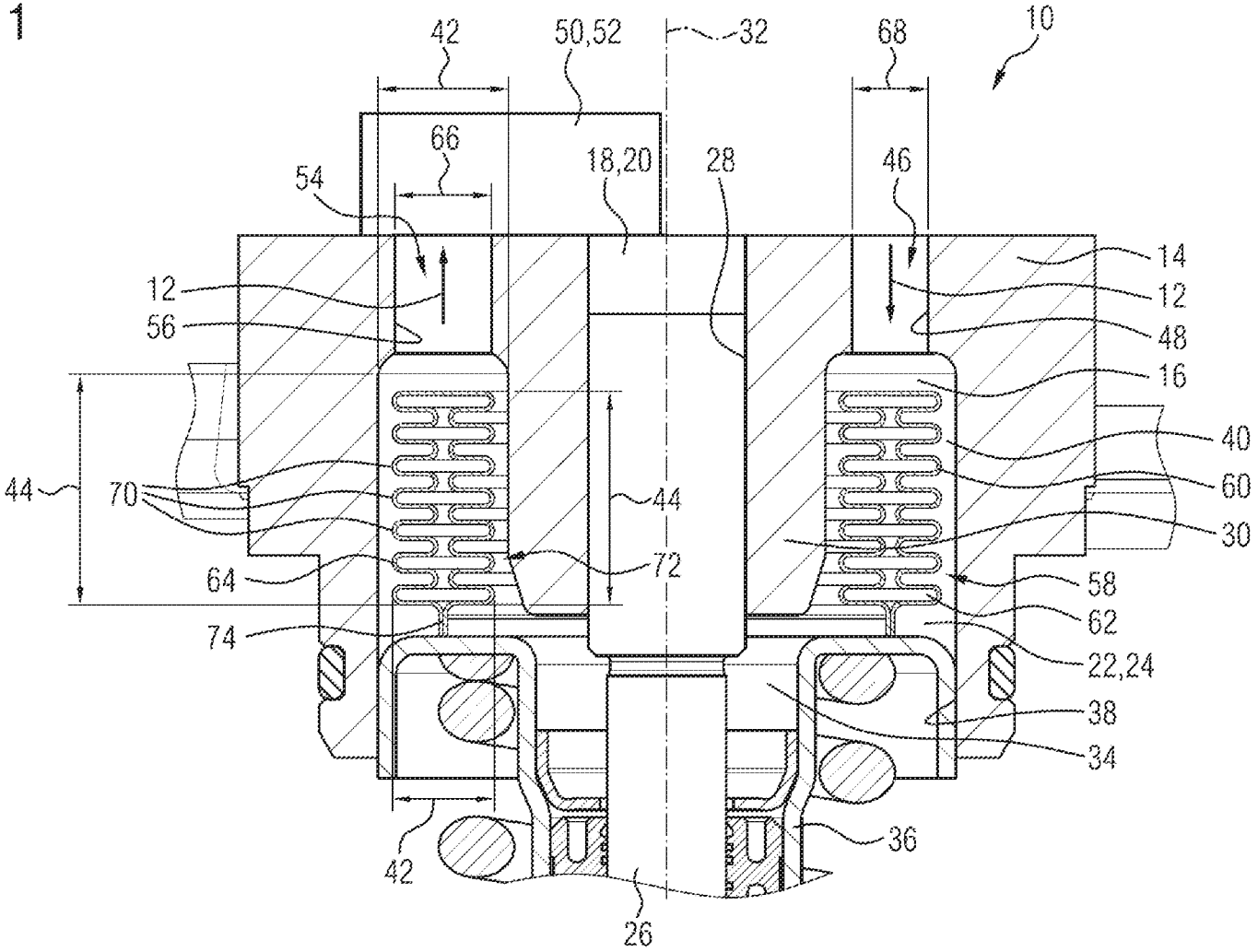
FIG. 1 is a sectional representation of a high-pressure fuel pump having a low-pressure damper in a first embodiment.

FIG. 1 is a sectional representation of a first embodiment of a high-pressure fuel pump 10 which can be used to apply high pressure to the fuel 12.

The basic construction of the high-pressure fuel pump 10, in this first embodiment shown in FIG. 1, is identical to the second to sixth embodiments described subsequently and shown in FIG. 2 to FIG. 7. For that reason, in the following the basic construction will be indicated and described only with reference to FIG. 1, and the description relating to the further embodiments will present only the differences with respect to this first embodiment.

The high-pressure fuel pump 10 in FIG. 1 has a housing 14 with a housing bore 16. The housing bore 16 forms, at a first end region 18, a pressure chamber 20 in which, during operation, pressure is applied to the fuel 12 by the volume of the pressure chamber 20 periodically contracting and expanding. The housing bore 16 also forms, at a second end region 22, a leakage chamber 24.

The high-pressure fuel pump 10 has a pump piston 26 which is guided in the housing bore 16. To that end, the housing bore 16 has a special pump piston guiding region 28 which is formed by a pump piston guiding section 30 on the housing 14 and which projects into the leakage chamber 24. In operation, the pump piston 26 moves back and forth in translation along an axis of movement 32, between the pressure chamber 20 and the leakage chamber 24. As a consequence of this movement of the pump piston 26 in the pressure chamber 20, fuel 12 which is present in this pressure chamber 20 is compressed and thus subjected to high pressure. In the process, a small proportion of the fuel 12 flows downward, along the pump piston guiding region 28 between the pump piston 26 and the pump piston guiding section 30 of the housing 14, and into the leakage chamber 24.

The leakage chamber 24 forms, in that region along the axis of movement 32 that is below the pump piston guiding region 28, a leakage collecting region 34 in which the fuel leakage from the pressure chamber 20 may be collected. In order to prevent this leakage fuel mixing with for example lubricating oil in a drive region of the pump piston 26, the leakage chamber 24 is sealed in a fluid-tight manner with a sealing shell 36 which is pressed against a housing wall 38 of the housing bore 16 and additionally secured by welding or screw-fitting. Thus, the sealing shell 36 and the housing wall 38 respectively form a boundary for the leakage collecting region 34.

The leakage chamber 24 also has, in addition to the leakage collecting region 34, an equalizing region 40 which performs multiple functions. On one hand, it serves to cushion a pressure change below the pump piston 26, which results from the movement of the pump piston. On the other hand, this equalizing region 40 is designed such that it also redirects forces which act on the housing 14 from outside the housing 14, for example as a consequence of the housing 14 being attached to other elements of a fuel injection system. To that end, the equalizing region 40 is arranged in circular annular fashion around the pump piston guiding section 30. It extends parallel to the axis of movement 32, from the leakage collecting region 34 toward the pressure chamber 20. In that context, a circular ring wall thickness 42 of the equalizing region 40 is smaller than an extent length 44. This special shape allows the equalizing region 40 to effectively absorb and divert forces from outside the housing 14.

The high-pressure fuel pump 10 further has an intake 46 via which fuel 12 from outside can be introduced into the high-pressure fuel pump 10. In that context, the intake 46 is arranged adjacent to the pressure chamber 20, opposite the leakage chamber 24 with respect to the pump piston 26. The leakage chamber 24 is fluidically connected to the intake 46 via an intake connecting bore 48. In the present embodiment, this intake connecting bore 48 extends essentially parallel to the pump piston guiding region 28, but can also be arranged not parallel thereto.

The high-pressure fuel pump 10 further has a metering valve 50 in order to be able to actively supply a predetermined quantity of fuel 12 to the pressure chamber 20. To that end, the metering valve 50 is designed as an electromagnetic switching valve 52. This metering valve 50 is also arranged adjacent to the pressure chamber 20 in the housing 14, opposite the leakage chamber 24 with respect to the pump piston 26. An inlet 54 of the metering valve 50 is fluidically connected to the leakage chamber 24, specifically via a valve connecting bore 56. This valve connecting bore 56 also extends parallel to the pump piston guiding region 28, but may alternatively also be arranged not parallel thereto. Advantageously, the intake connecting bore 48 and the valve connecting bore 56 are arranged opposite one another with respect to the pump piston 26.

A low-pressure damper 58 is arranged in the leakage chamber 24, specifically such that it is located in the equalizing region 40 of the leakage chamber 24.

The low-pressure damper 58 has a bellows-shaped corrugated damper plate 60 which bounds a damper volume 62. The low-pressure damper 58 largely fills the equalizing region 40 since it is also designed as a damper circular ring 64 which is arranged around the pump guiding section 30 of the housing 14, and also has a circular ring wall thickness 42 that is considerably smaller than an extent length 44 parallel to the axis of movement 32.

A valve connecting bore diameter 66 of the valve connecting bore 56 is larger than an intake connecting bore diameter 68 of the intake connecting bore 48. That means that the leakage chamber 24, as a sealing and damping chamber, has one connection to the intake 46 and another to the metering valve 50, wherein the bore to the metering valve 50 is larger than that to the intake 46. If, for reasons of installation space, it is not possible to create, in the housing 14 of the high-pressure fuel pump 10, a valve connecting bore 56 having a larger diameter, it is also possible to provide multiple valve connecting bores 56 which are then together larger in diameter than the single diameter 68 of the intake connecting bore 48.

As a result, the low-pressure damper 58 operates correctly in the case of a reflux of fuel 12 from the metering valve 50 into the leakage chamber 24, since a larger quantity of fuel flows into the leakage chamber 24 via the valve connecting bore 56 than can flow out of the intake connecting bore 48. Thus, one might say that the low-pressure damper 58 is forced to work.

The high-pressure fuel pump 10 has no other connecting bore between the intake 46 and the inlet 54 of the metering valve 50, and therefore fuel 12 supplied from outside must necessarily flow via the leakage chamber 24 in order to be able to arrive at the metering valve 50 and thus into the pressure chamber 20. Thus, all of the intake hydraulics is routed via the low-pressure damper 58 which can thus very effectively damp all of the pressure pulsations which arise. This has the additional advantage that hot leakage fuel is mixed with cool fuel 12 from the intake 46, such that the high-pressure fuel pump 10 may be cooled effectively.

The provision of the low-pressure damper 58 in the leakage chamber 24 of the high-pressure fuel pump 10 makes it possible to provide maximum flexibility in terms of the interfaces at the head of the high-pressure fuel pump 10. For example, the metering valve may easily be arranged at the upper end of the housing 14, axially with respect to the pump piston 26, and thus provide a direct suction path from a reservoir, for example from a tank. This makes it possible to increase the volumetric efficiency of the high-pressure fuel pump 10. In addition, this placing of the metering valve 50 makes it possible for the orientation of a plug that is required for connecting the metering valve 50 to be variable through 360°. This pump architecture also provides maximum flexibility with respect to orientation of a suction port and a high-pressure output of the high-pressure fuel pump 10. The fact that the low-pressure damper 58 is arranged further from the metering valve 50 than was the case hitherto, the pressure pulsations which arise at the low-pressure damper 58 are also expected to be lower.

All of the embodiments described below have the features described with reference to FIG. 1.

FIG. 1 shows a first embodiment of the high-pressure fuel pump 10, or of the low-pressure damper 58. In this case, the bellows-shaped corrugated damper plate 60 has corrugations 70 which propagate parallel to the axis of movement 32. This allows the low-pressure damper 58 to expand well parallel to the axis of movement 32, and to work in the direction of the flowing fuel 12. The damper plate 60 forms a hermetic capsule 72 which represents the damper volume 62. To that end, the damper plate 60 is bent in corrugated fashion and is welded to itself. The damper plate 60 further has a flange 74 which is formed at an end region of the damper plate 60, and which does not contribute to forming the capsule 72. With this flange 74, the damper plate 60—and thus the low-pressure damper 58—is secured to the sealing shell 36, namely solidly welded. In other words, in this case the low-pressure damper 58 is a gas-filled capsule 72 which is welded to the sealing shell 36 that simultaneously forms a resilient support subassembly.

Figure 2:
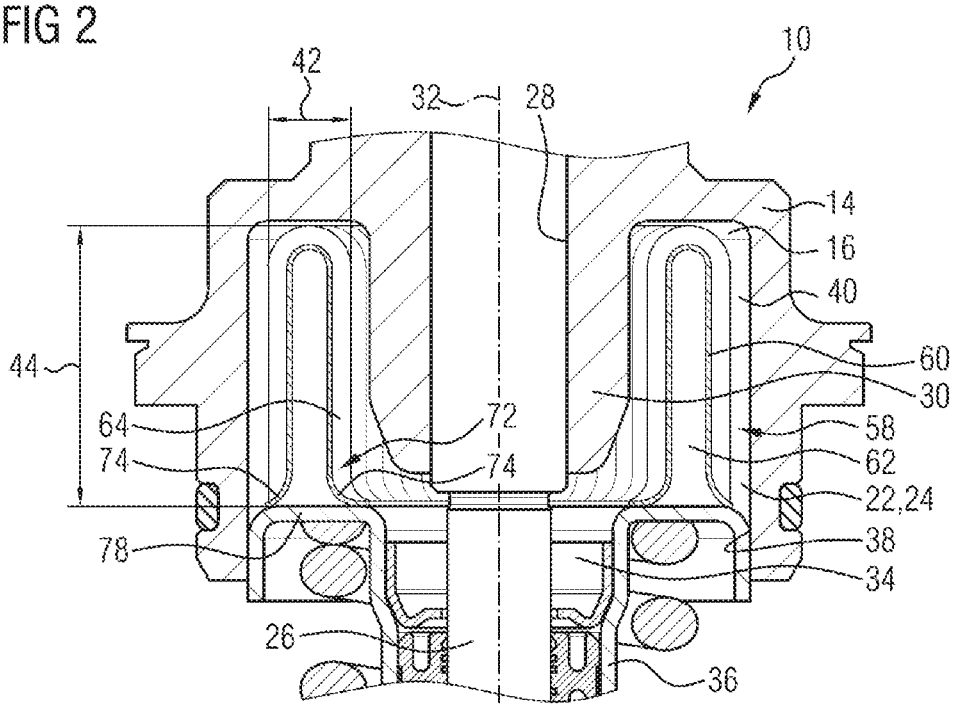
FIG. 2 is a sectional representation of a high-pressure fuel pump having a low-pressure damper in a second embodiment.
Figure 3:
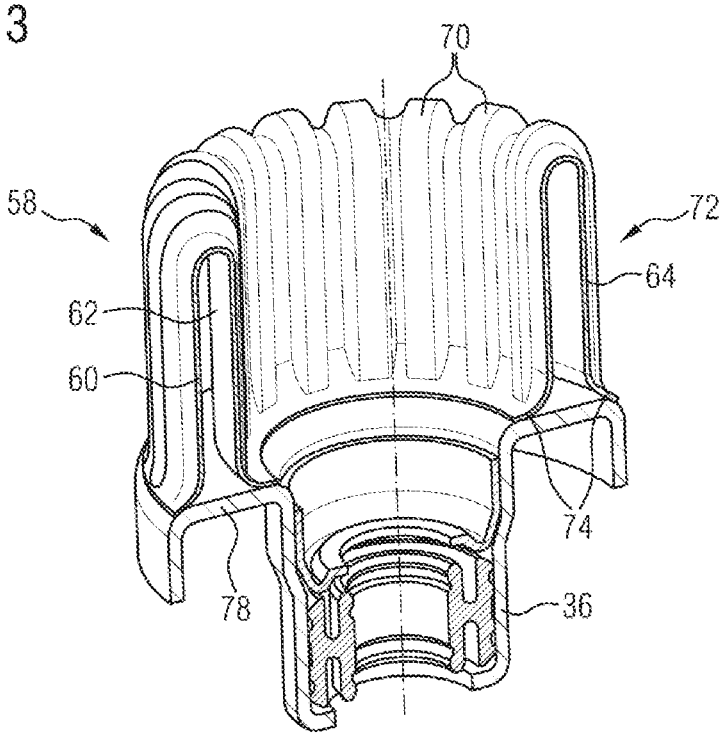
FIG. 3 is a perspective illustration of a part region of the low-pressure damper of FIG. 2.

FIG. 2 and FIG. 3 respectively show a second embodiment of the high-pressure fuel pump 10, in which the low-pressure damper 58 has a damper plate 60 that does not by itself form the capsule 72, but rather is secured, namely solidly welded, to the sealing shell 36 such that the damper plate 60 and the sealing shell 36 together form the capsule 72. This means that the damper plate 60 is in the form of an open variant which uses the resilient support subassembly as a closure means. In the second embodiment, the corrugations 70 possessed by the bellows-shaped corrugated damper plate 60 are also arranged in annular fashion around the pump piston guiding section 30. Thus, in operation, the low-pressure damper 58 expands perpendicular to the low-pressure damper 58 in the first embodiment in FIG. 1.

FIG. 1 and FIG. 2 show two different constructions for the low-pressure damper 58, wherein in one variant, which is shown in FIG. 1, volume is compensated in the axial direction, while in the other variant, which is shown in FIG. 2 and FIG. 3, the volume is compensated radially.

Figure 4:
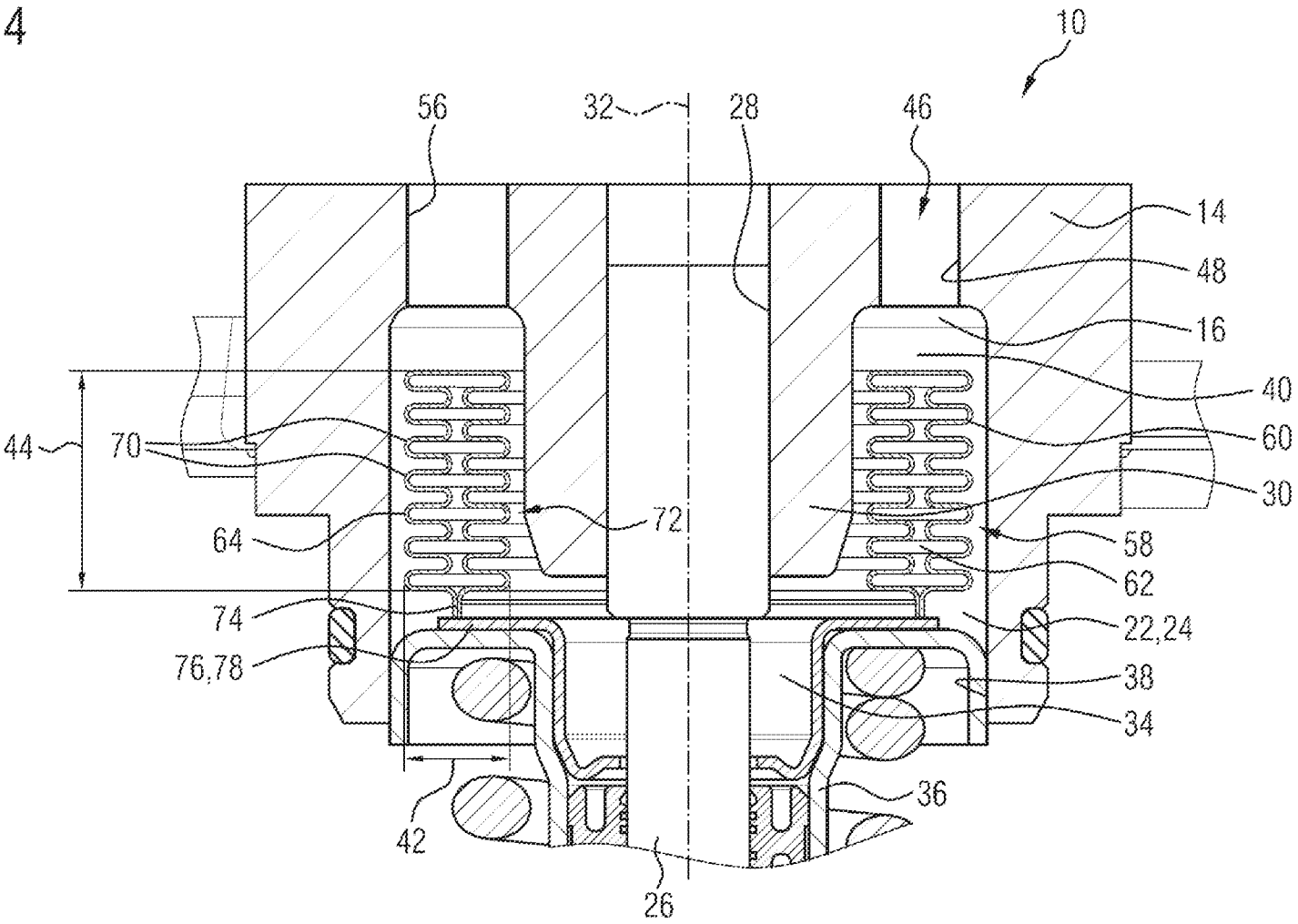
FIG. 4 is a sectional representation of a high-pressure fuel pump having a low-pressure damper in a third embodiment.

FIG. 4 shows a third embodiment of the high-pressure fuel pump 10 which essentially corresponds to the first embodiment, but with the difference that the damper plate 60 with the flange 74 is not welded directly to the sealing shell 36 itself, but rather to a piston support plate 76 which forms a part region 78 of the sealing shell 36 but which is not part of the sealing shell 36 from the beginning and is subsequently pressed into this shell. This allows the subassembly consisting of or including the low-pressure damper 58 and the piston support plate 76 to be prefabricated and only subsequently integrated into the sealing shell 36.

Figure 5:
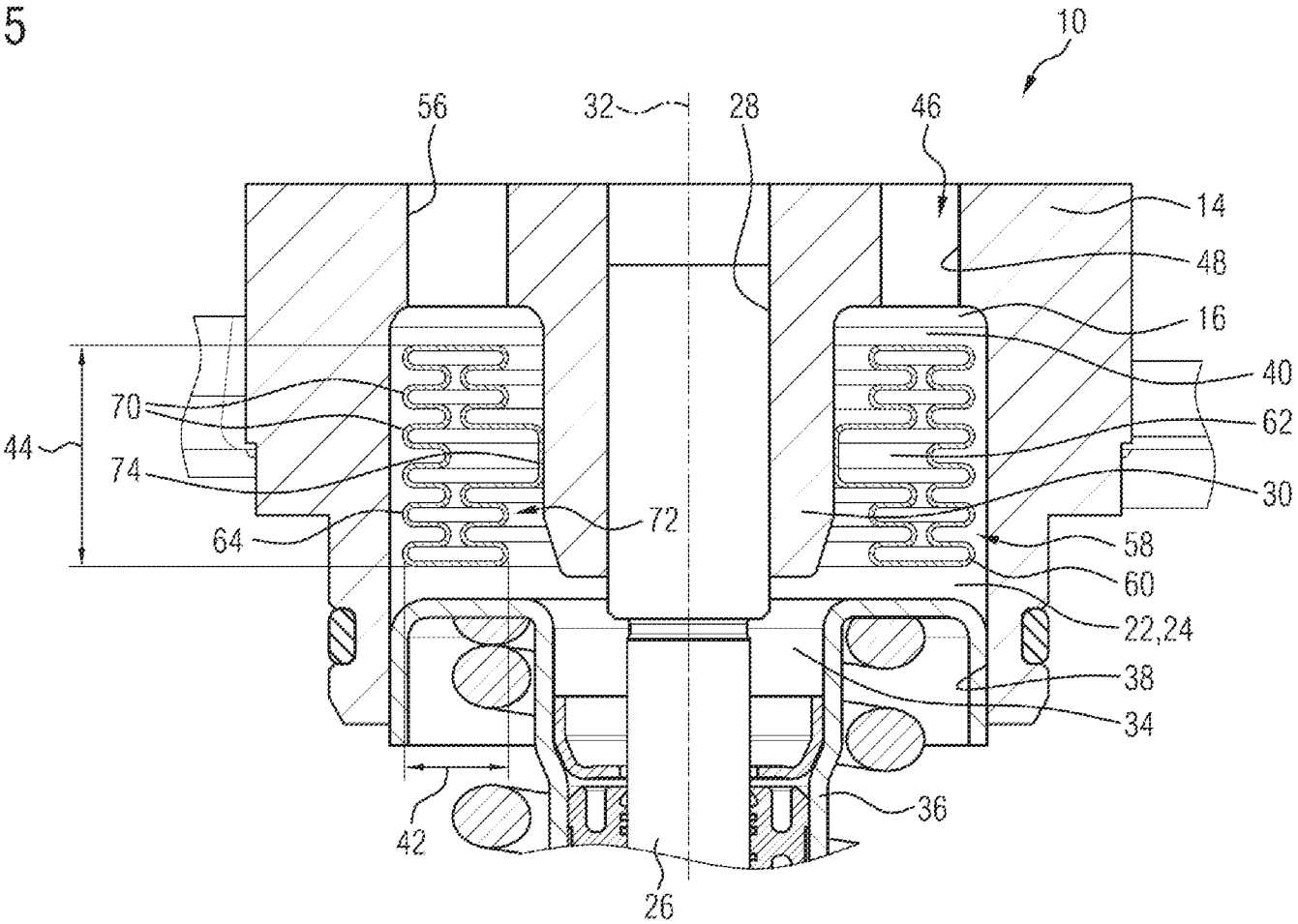
FIG. 5 is a sectional representation of a high-pressure fuel pump having a low-pressure damper in a fourth embodiment.

FIG. 5 shows a fourth embodiment of the high-pressure fuel pump 10 with another alternative option for securing the low-pressure damper 58 in the leakage chamber 24. In this case, the capsule 72 is pressed—but can also be welded—onto the pump piston guiding section 30 of the housing 14, which essentially forms a cylinder base. Advantageously, in this context, the capsule 72 has a flange 74 which is arranged centrally such that the capsule 72 can expand in two directions parallel to the axis of movement 32.

Figure 6:
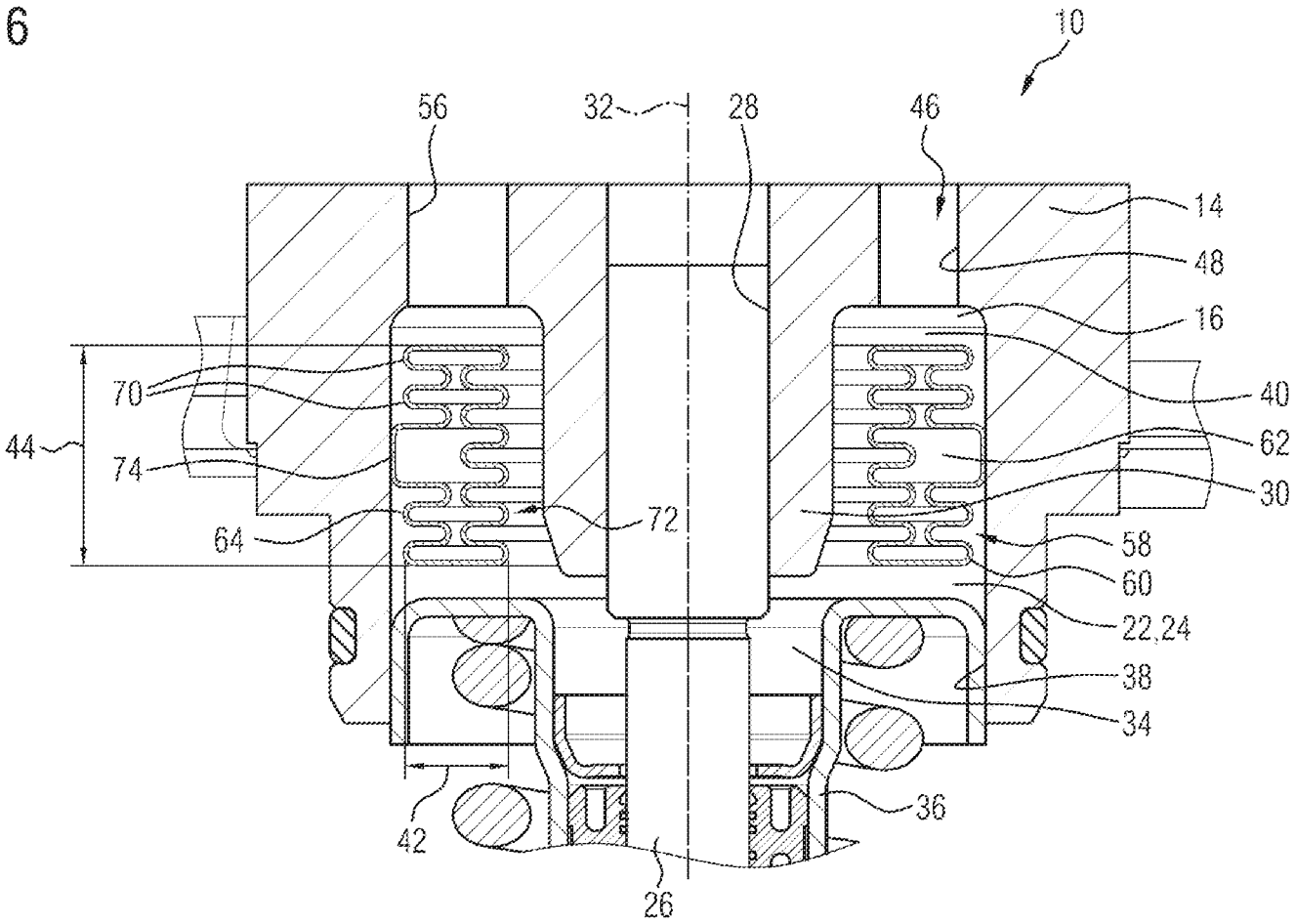
FIG. 6 is a sectional representation of a high-pressure fuel pump having a low-pressure damper in a fifth embodiment.
Figure 7:
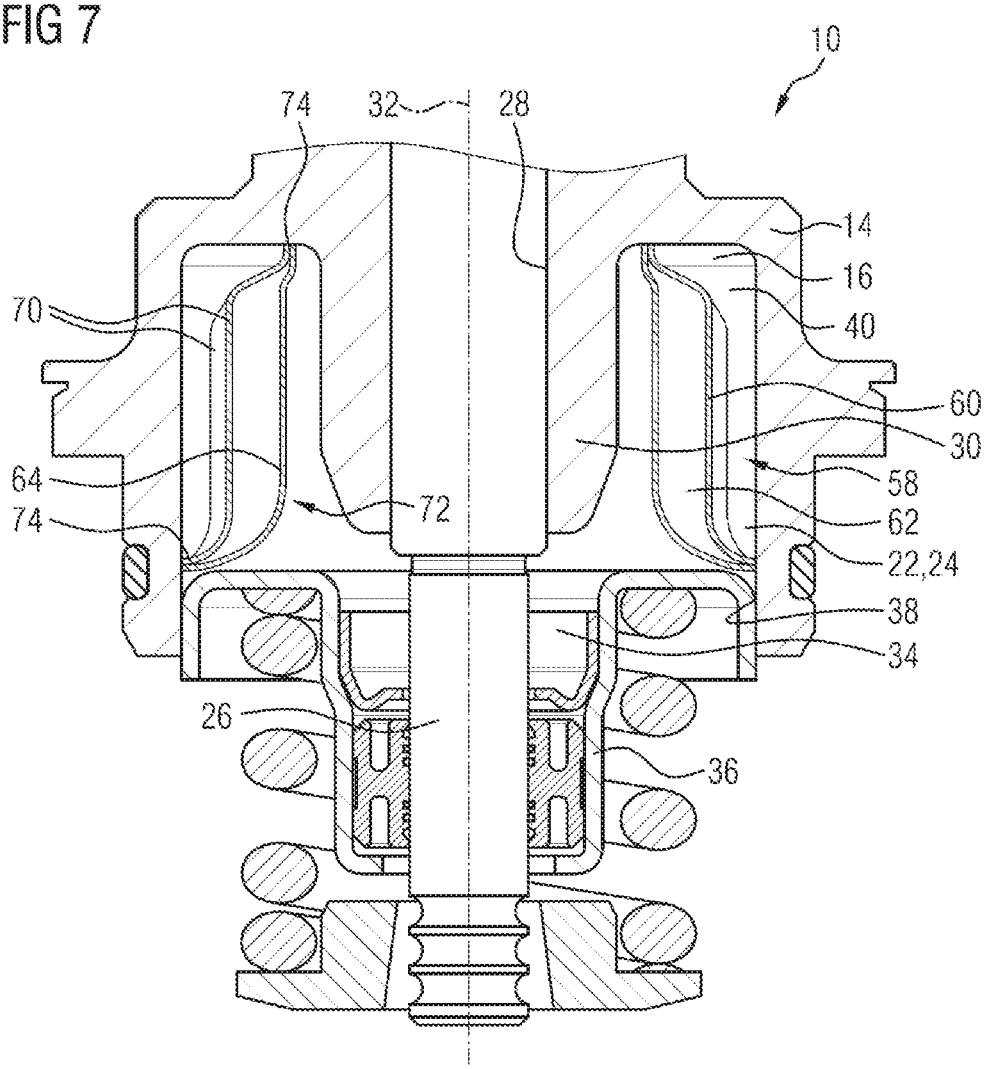
FIG. 7 is a sectional representation of a high-pressure fuel pump having a low-pressure damper in a sixth embodiment.

FIG. 6 shows a fifth embodiment of the high-pressure fuel pump 10, in which the low-pressure damper 58 is secured to that housing wall 38 on which the sealing shell 36 is also arranged by pressing, in other words in this variant the capsule is pressed onto the receiving diameter of the resilient support subassembly, but may also be welded there. Here, too, a flange 74 is advantageously arranged centrally, so that the low-pressure damper 58 may expand in two directions along the axis of movement 32. In that context, FIG. 6 shows, in the fifth embodiment, a variant in which the low-pressure damper 58 is secured to the housing wall 38 by pressing, while FIG. 7 shows a sixth embodiment, in which the low-pressure damper 58 is secured to the housing wall 38 by welding.

The foregoing embodiments have been shown and described for the purposes of illustrating the structural and functional principles of the present invention, as well as illustrating the methods of employing the embodiments and are subject to change without departing from such principles. Therefore, this invention includes all modifications encompassed within the scope of the following claims.

The invention claimed is:

1. A high-pressure fuel pump for applying high pressure to fuel in a fuel injection system, comprising:

a housing having a housing bore which forms, at a first end region, a pressure chamber in which high pressure is applied to the fuel, and forms, at a second end region, a leakage chamber;

a pump piston which partially extends into the pressure chamber and partially extends into the leakage chamber, and the pump piston is guided in a pump piston guiding region of the housing bore, formed by a pump piston guiding section of the housing, and which, during operation of the high-pressure fuel pump, moves in translation between the pressure chamber and the leakage chamber along an axis of movement, wherein the leakage chamber has a leakage collecting region and an equalizing region, the equalizing region is arranged in circular annular fashion around the pump piston guiding section of the housing and extends parallel to the axis of movement from the leakage collecting region toward the pressure chamber; and a low-pressure damper having a bellows-shaped corrugated damper plate which bounds a damper volume;

wherein the low-pressure damper is arranged in the equalizing region.

2. The high-pressure fuel pump as claimed in claim 1, wherein the low-pressure damper is a damper circular ring having a circular ring wall thickness perpendicular to the axis of movement and an extent length parallel to the axis of movement, and wherein the circular ring wall thickness is smaller than the extent length.

3. The high-pressure fuel pump as claimed in claim 1, wherein the bellows-shaped corrugated damper plate has corrugations which one of propagate parallel to the axis of movement and propagate in annular fashion around the pump piston guiding section of the housing.

4. The high-pressure fuel pump as claimed in claim 1, wherein the damper plate forms a hermetically closed capsule which forms the damper volume.

5. The high-pressure fuel pump as claimed in claim 1, wherein the housing has, adjacent to the pressure chamber and opposite the leakage chamber with respect to the pump piston, an intake for introducing fuel into the high-pressure fuel pump, wherein the intake is fluidically connected to the leakage chamber, and wherein an intake connecting bore, which extends generally parallel to the pump piston guiding region of the housing bore between the intake and the leakage chamber, is arranged in the housing.

6. The high-pressure fuel pump as claimed in claim 1, further comprising an electromagnetic switching valve serving as a metering valve for metering fuel to the pressure chamber, the electromagnetic switching valve is arranged on the housing adjacent to the pressure chamber and opposite the leakage chamber with respect to the pump piston, wherein an inlet of the electromagnetic switching valve is fluidically connected to the leakage chamber, and a valve connecting bore, which extends essentially parallel to the pump piston guiding region of the housing bore between the inlet of the electromagnetic switching valve and the leakage chamber, is arranged in the housing.

7. The high-pressure fuel pump as claimed in claim 6, wherein a diameter of the valve connecting bore is larger than a diameter of an intake connecting bore.

8. The high-pressure fuel pump as claimed in claim 1, further comprising a sealing shell, wherein the leakage collecting region is bounded by the sealing shell which is secured pressed against a housing wall of the housing bore.

9. The high-pressure fuel pump as claimed in claim 8, wherein the low-pressure damper is secured, by welding or pressing, to at least one of the sealing shell, the housing wall, and the pump piston guiding section of the housing.

10. The high-pressure fuel pump as claimed in claim 8, wherein the damper plate, together with a part region of the sealing shell, forms a hermetically closed capsule which forms the damper volume, and wherein the part region is formed by a piston support plate pressed into the sealing shell.

* * * * *